United States Patent [19]

Hopler, Jr.

[11] 4,040,355

[45] Aug. 9, 1977

[54] EXCAVATION APPARATUS AND METHOD

[75] Inventor: Robert B. Hopler, Jr., Succasunna, N.J.

[73] Assignee: Hercules Incorporated, Wilmington, Del.

[21] Appl. No.: 621,200

[22] Filed: Oct. 9, 1975

[51] Int. Cl.[2] ..... F42D 3/04

[52] U.S. Cl. ..... 102/22 R; 86/20 C; 102/23; 175/4.5; 299/13

[58] Field of Search ..... 299/13; 175/2, 4.5; 86/20 C; 102/23, 22

[56] References Cited

U.S. PATENT DOCUMENTS

| | | | |
|---|---|---|---|
| 2,834,245 | 5/1958 | Osborne | 102/22 X |
| 3,104,584 | 9/1963 | Jacobs | 86/20 C |
| 3,266,845 | 8/1966 | Williamson et al. | 102/23 X |
| 3,511,538 | 5/1970 | Guenter | 299/13 |
| 3,623,771 | 11/1971 | Sosnowitz et al. | 102/23 X |
| 3,877,373 | 4/1975 | Bergmann et al. | 102/23 |

*Primary Examiner*—David H. Brown
*Attorney, Agent, or Firm*—Joshua W. Martin, III; Michael B. Keehan

[57] ABSTRACT

Apparatus for loading and initiating percussion-initiatable delay type explosive charges for excavating earth formations, comprising a tubular loading member longitudinally movable into and from explosives loading position, and means for ingress of the explosive charges successively into the tubular loading member for loading; a charge displacement member forwardly movable within the tubular loading member for forwardly displacing each charge through the tubular loading member when the latter is advanced for said loading; a pin member movable from within the charge displacement member into percussion initiating impact with the forwardly displaced charge; said tubular loading member retractable from its advanced position for said loading during the delay period of the explosive charge, and the displacement member together with the firing pin carried therein being retractable from the initiation zone in response to and concurrently with retraction of the tubular loading member. A tubular member concentric with the above-described system constitutes a preferred support component. Associated means are provided for moving the tubular loading, displacement and firing pin members during the loading, initiation and retraction.

Also provided are drilling and blasting apparatus including a loading-initiation apparatus above described and method.

18 Claims, 23 Drawing Figures

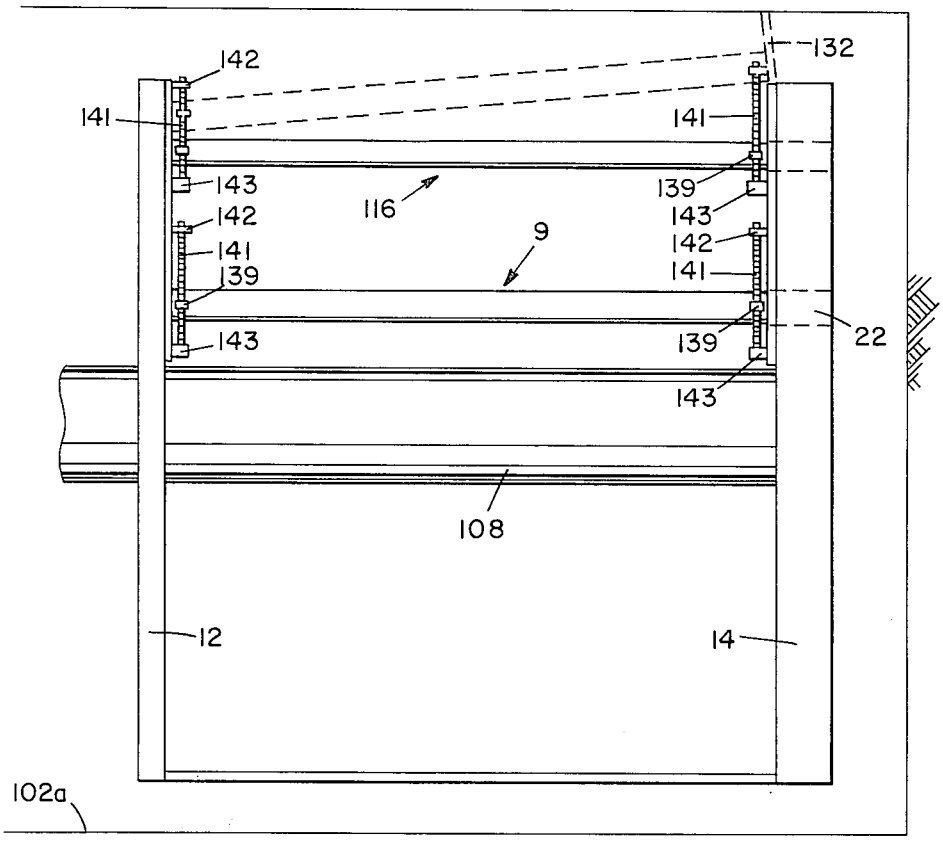
FIG. 13
FIG. 14
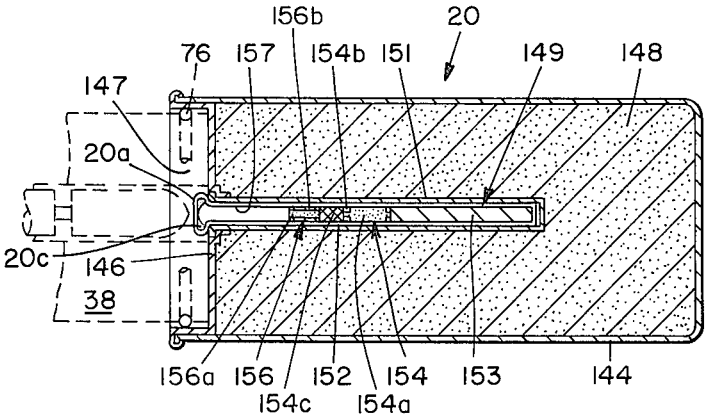

EXCAVATION APPARATUS AND METHOD

This invention relates to apparatus for excavating with explosives. In one aspect this invention relates to apparatus for loading delay type explosives in earth formations by positive displacement, initiating the explosive, and then withdrawing the displacement and initiating means from the initiation zone during the delay period. In one aspect, this invention relates to apparatus for loading and initiating delay type explosive charges on a continuous operating cycle basis. In another aspect, this invention relates to drilling and blasting apparatus particularly adaptable to drilling and blasting hard rock formations and including explosives loading and initiating means above described. In another aspect this invention relates to a method for loading and initiating delay type explosives in earth formations. Other aspects will be apparent in light of the accompanying disclosure and the appended claims.

Various means have been proposed for loading explosives for detonation. Hand loading explosive cartridges and subsequent detonation utilizing conventional initiator means involve high time and manpower requirements. Other cartridge loading techniques involve emplacement of a suitable loading tube in a borehole, pneumatically driving the explosive cartridge through the loading tube into emplacement, withdrawing the loading tube, and initiating the detonation, all or part of the initiator means having been emplaced during the loading operation. This procedure though it involves pneumatic operation still requires time and manpower consuming steps which are economically undesirable. In still another cartridge loading operation, the explosive cartridge, during emplacement, is a mass freely moving under force responsive to the pressure of a moving pneumatic stream, and hence the momentum of the explosive must be overcome for final emplacement. The initial position of the emplaced explosive is not precisely controlled, and realignment of the initiator means, or suitable revision of the initiating operation, is often required in order to assure requisite initiator/explosive contact.

In U.S. Pat. No. 3,623,771, apparatus is disclosed which provides an explosives loading system including means for pneumatically driving explosive cartridges through a plurality of loading tubes into emplacement in a borehole, withdrawing the loading tubes, rotating the loading system to move the loading tubes from operative loading position to then move an initiator means, such as a projectile system, into initiating alignment with the emplaced explosive, and then advancing the initiator into initiating contact with the loaded explosive. This system, concerned with pneumatic operation in lieu of hand loading, nevertheless involves numerous operating steps particularly with reference to the separate steps required for moving the initiator means into operative alignment with the emplaced explosive for the detonation, again involving a high time and manpower consuming sequence.

In U.S. Pat. No. 3,511,538 an explosive loading system is disclosed which provides for percussion initiating a delay type explosive prior to emplacement in a borehole followed by displacement of the initiated explosive into the borehole and withdrawal of the entire displacement means — all during the delay period. Hence, U.S. Pat. No. 3,511,538 involves equipment and manpower requirements lower than those of U.S. Pat. No. 3,623,771, but requires that the entire loading, and initiating procedure be accomplished during the delay period.

This invention is concerned with apparatus and method for loading and initiating delay type explosive charges in earth formations under positive displacement and initiating conditions providing for manpower, equipment and time requirements markedly less, and for precision of emplacement with concomitant reliability of initiation greater, than have been possible heretofore; and with apparatus for drilling and blasting earth formations including the explosives loading and initiating apparatus as a component.

In accordance with the invention, apparatus is provided for loading and initiating delay-type percussion initiatiable explosive charges, which comprises a tubular explosives loading member longitudinally movably supported for advancement for loading said charges;

passageway means through a side wall of said tubular loading member for ingress of said charges successively into a rearward section thereof, and said passageway means disposed for said ingress when said tubular loading member is advanced for said loading;

a charge displacement member forwardly movable within said tubular loading member from a position rearward of said rearward section when said tubular loading member is advanced as described so as to be in positive displacement relationship with each said charge within said rearward section to forwardly displace same at least into a forward section of said tubular loading member for percussion initiation;

a firing pin member forwardly movable from within said displacement member into percussion initiating impact with each said charge when forwardly displaced as described;

said tubular loading, charge displacement and firing pin members each retractable from its forwardmost portion for said ingress, displacement, and percussion initiating impact respectively;

means for retraction of said tubular loading member from said forwardmost position of same during the period of said delay, and said displacement member together with said firing pin member carried therein retractable from its above described forwardmost position in response to, and concurrently with, said retraction of said tubular loading member.

The apparatus in preferred practice comprises four substantially concentric members, viz., an outermost tubular support member, and interiorly therefrom in the order named, the tubular loading member, a piston head as the charge displacement member, and the firing pin member, together with associated drive means for longitudinally moving the inner members.

In a preferred embodiment, the tubular loading member when advanced, i.e. forwardly moved from within the tubular support member, is preferably of sufficient length to reach the "bottom" of a borehole in alignment therewith, and in that position to be in alignment with the tubular support member for sequentially receiving explosive charges from outside the system through the top side wall of each of the tubular members. In that position, the piston head is rearward of the explosive charge in the tubular loading member, so that it is forwardly movable in positive displacement contact with each explosive charge and it is adapted to supportably retain the forwardly displaced charge in position in the borehole for the initiation. The firing pin is stationary within the piston during the displacement of the explosive charge, i.e., it rides within the piston until after forward displacement of the explosive charge. After the piston is in supporting relationship with the forwardly displaced charge in the borehole, the firing pin is forwardly movable from within the piston head into percussion-initiating impact with the charge. Means is provided for retraction of the explosive loading tube and, concurrently, the piston assembly with firing pin member carried therein, into the tubular support member during the delay period, which is generally from about ½ to 5 seconds. Endless chain drive, clutch and associated apparatus components provide for operation of the advancement, firing and retraction functions.

Further in accordance with the invention, a method for loading and initiating a delay-type percussion initiatable explosive charge in an earth formation to form earth breakage product is provided which ciomprises displacing said explosive charge by positive displacement means into a borehole in said earth formation for initiation of same;

supporting the thus displaced explosive charge so as to be initiable by force of percussion impact of an advancing firing pin, and advancing said firing pin into said percussion-initiating impact; and concurrently withdrawing said firing pin and said displacement means from said borehole during the period of said delay.

Apparatus and method of the invention are further illustrated with reference to the drawings, of which FIG. 1 is a cross-sectional view of an explosives loading and initiating apparatus of the invention, in which all components are in fully retracted position for beginning the explosives loading and initiating operation, FIG. 1A is an enlarged view taken along the line 1A—1A of FIG. 1, and FIG. 1B is an enlarged and more detailed view taken along the line 1B—1B of FIG. 1;

FIG. 2 is a view of the apparatus of FIG. 1 except that the tubular loading member is shown in advanced position for receiving an explosive charge to be emplaced in a borehole;

FIG. 3 is the same as FIG. 2 except that it shows the displacement member of FIG. 2 in supporting contact with the explosive charge after forward displacement of said into a borehole for the initiation, and FIG. 3A, enlarged, and in more detail, shows the forwardly displaced charge of FIG. 3 following percussion initiation with substantially concurrent disengagement of the initiated charge from supporting contact with the displacement member in response to force of the percussion initating impact;

Figure 3:
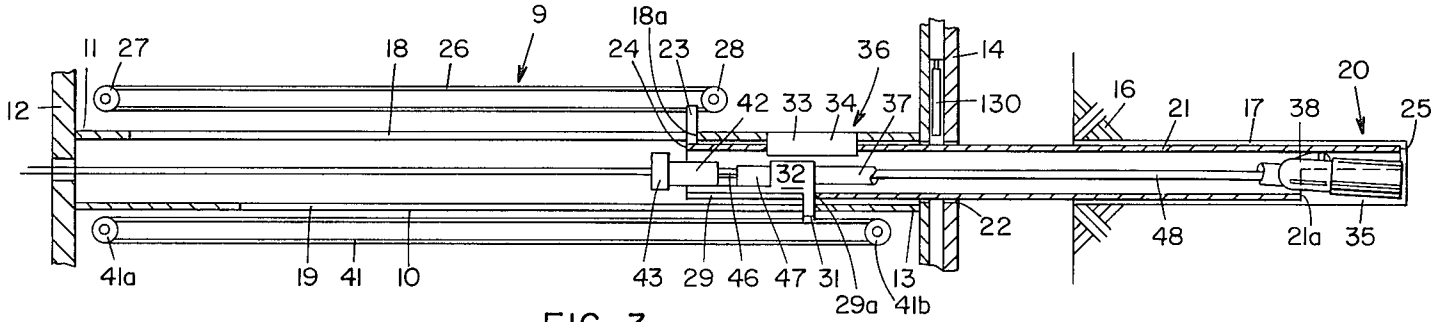
Figure 4:
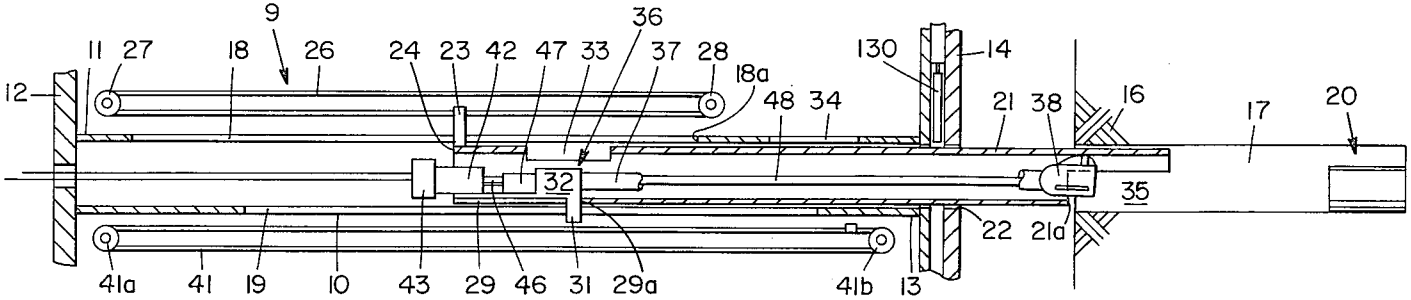
FIG. 4 is a view of the apparatus of FIG. 3 except that it shows the initiated explosive charge completely disengaged from supporting contact with the displacement member and emplaced in the borehole, together with the apparatus in process of being retracted into its position of FIG. 1 during the delay period of the explosive charge.
Figure 5:
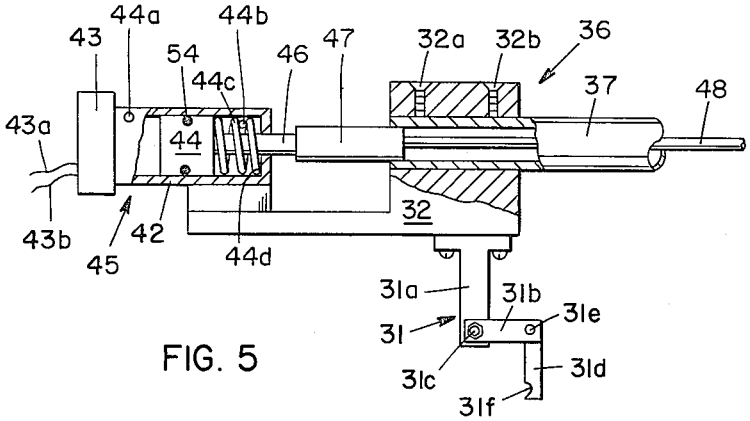
FIG. 5 is an enlarged and more detailed view of rearward structure of the apparatus of FIG. 1.
Figure 8:
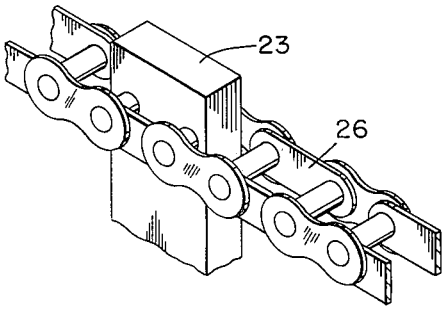
FIGS. 8 and 8A are perspective views of endless chain drive portions of FIGS. 1–4 operatively engaging the tubular loading and displacement members respectively.
Figure 8A:
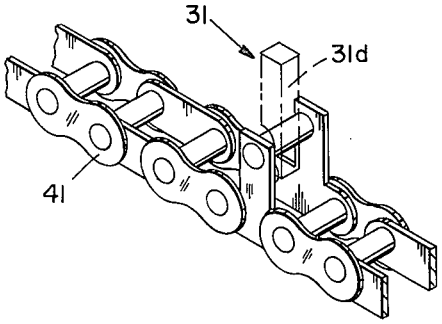
Figure 9:
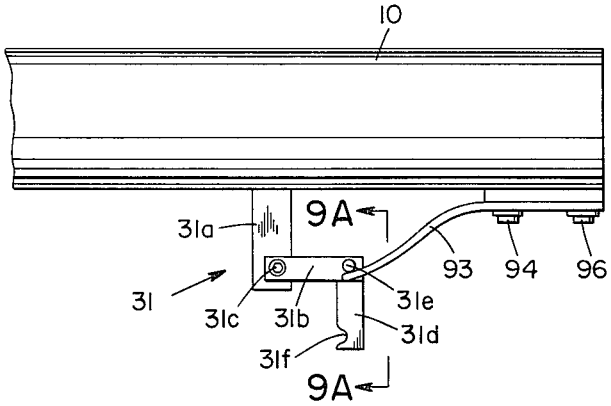
Figure 9A:
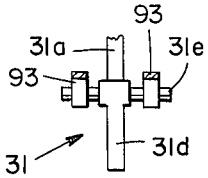
Figure 10:
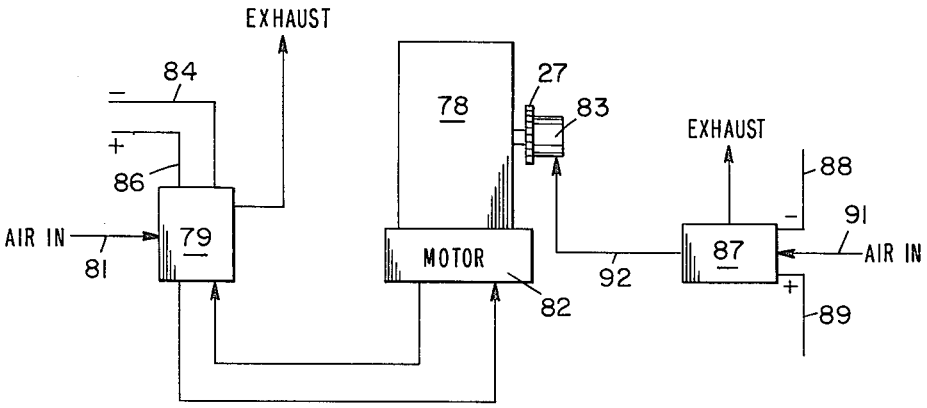
Figure 10A:
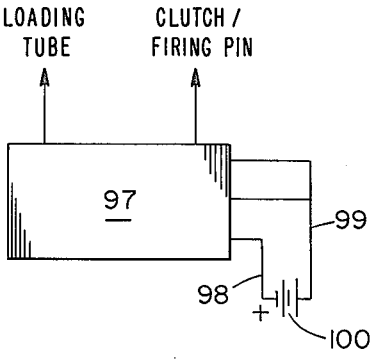
Figure 11:
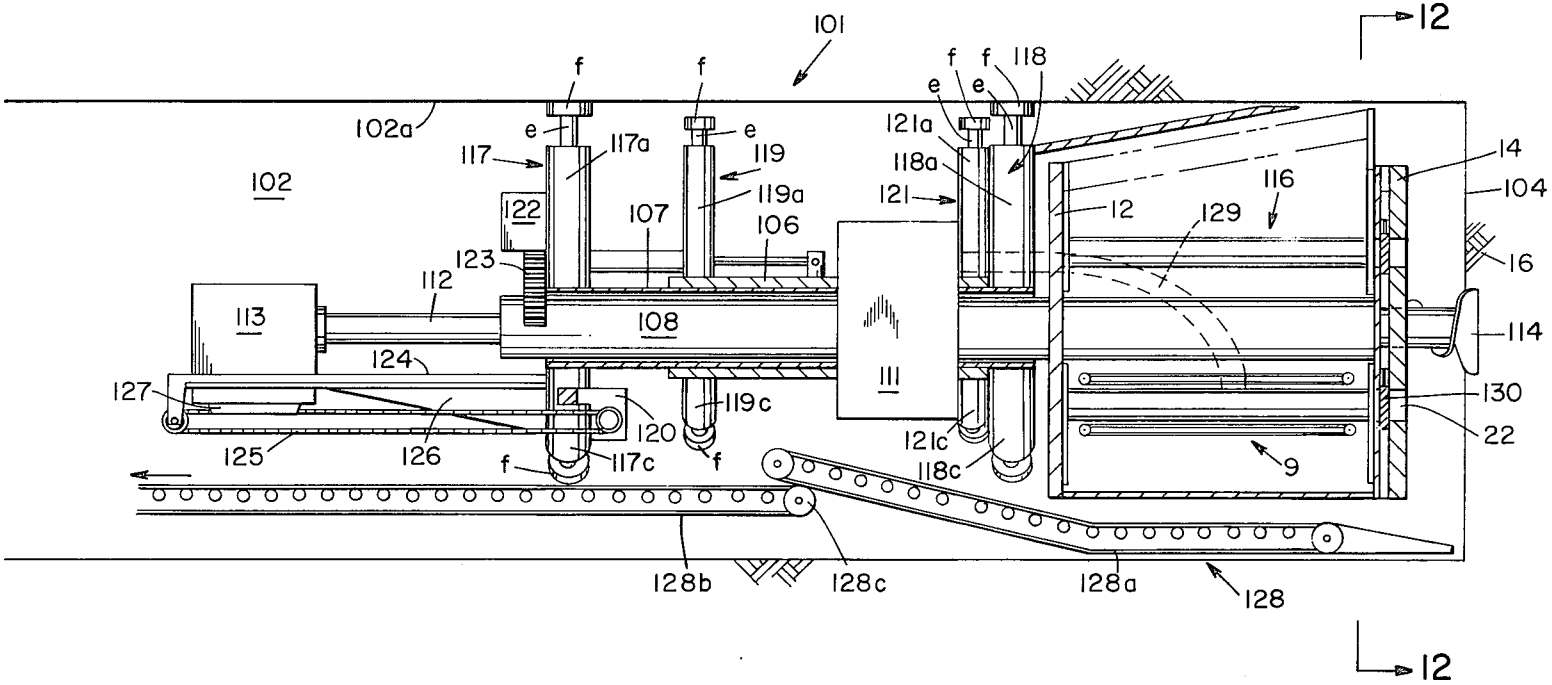
Figure 12:
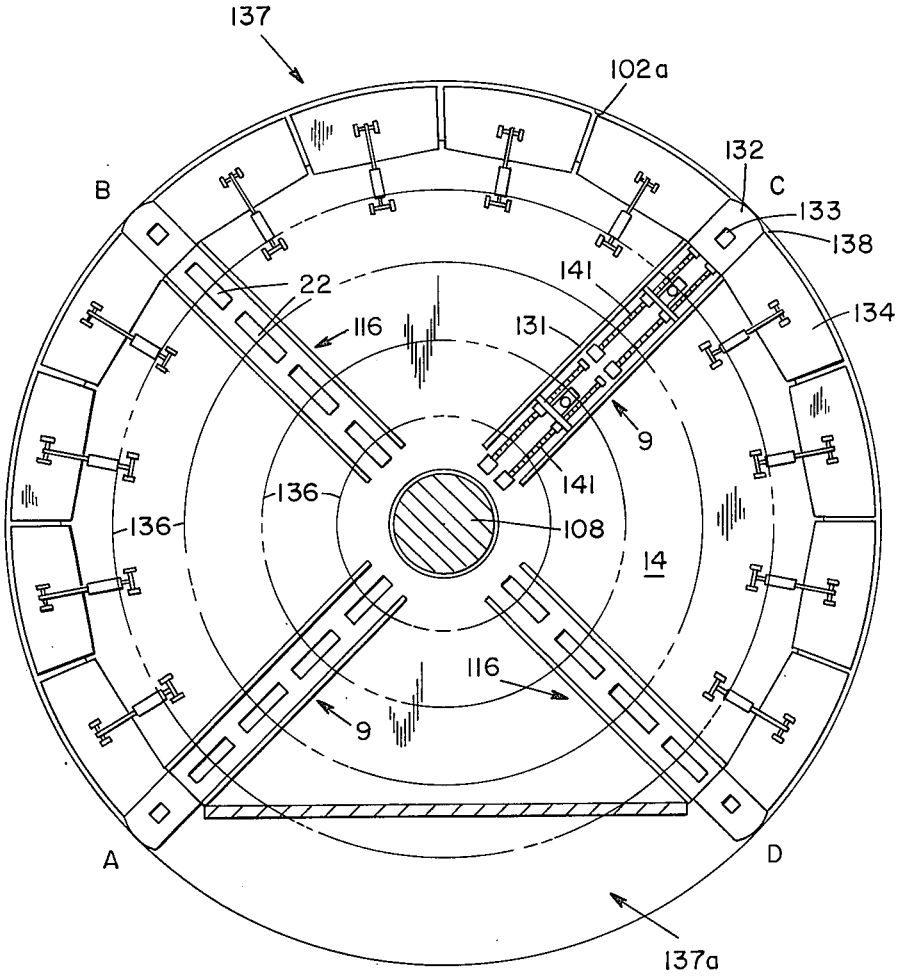

FIG. 9 is a view of track structure at a forward end of the tubular support member of FIGS. 1–4 (not shown) for disengaging the endless chain assembly of FIG. 8A from operative connection with the charge displacement member after the requisite forward travel of the latter, and FIG. 9A illustrates in more detail chain connector structure of FIG. 5 operatively associated with the track of FIG. 9 for the disengagement;

FIG. 10 diagrammatically shows a now preferred electrical and hydraulic hookup for operating the loading and initiating apparatus of the invention, and FIG. 10A further diagrammatically illustrates cyclic operation thereof;

FIG. 11 is a partial cross-sectional view of a now preferred embodiment of drilling and blasting apparatus of the invention of which at least one explosive loading and initiating apparatus, above described, is a component;

FIG. 12 is an enlarged view taken along the lines 12—12 of FIG. 11;

FIG. 13 is a side view of now preferred means for operatively supporting explosive loading tube and rotary drill units in the machine of FIG. 11; and FIG. 14 illustrates a now preferred form of percussion-inititable explosive charge loaded and initiated for detonation in accordance with the invention.

When referring herein to loading, in accordance with the invention, it is meant the delivery of the explosive charge into position for the requisite percussion initiation and subsequent emplacement for detonation. Like parts in the drawings are designated by like numbers.

Figure 1:
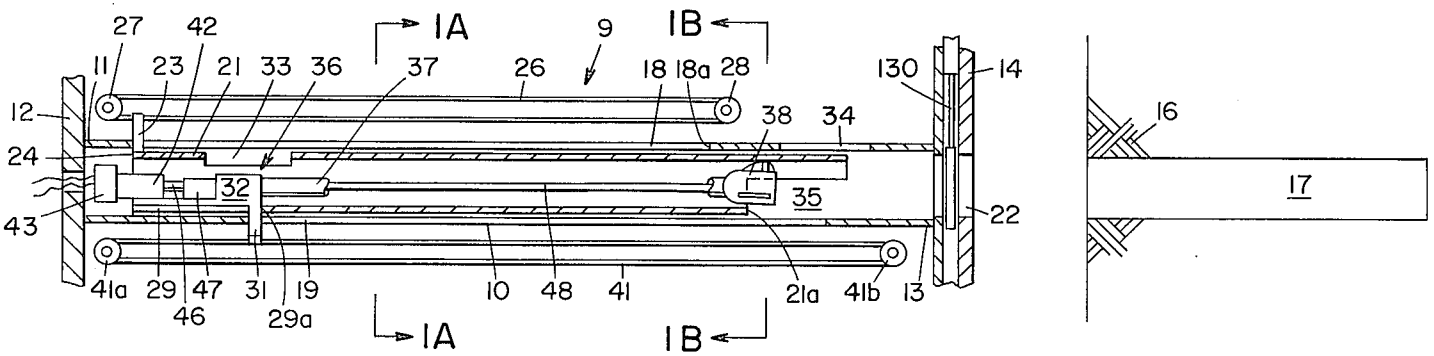
Figure 1B:
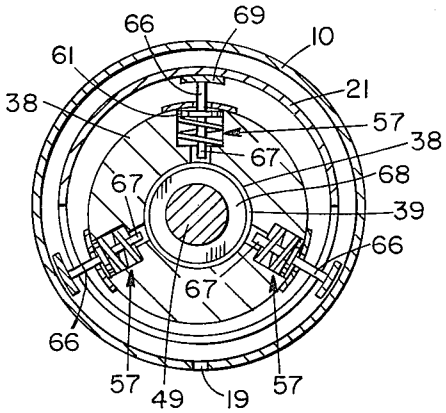
Figure 1A:
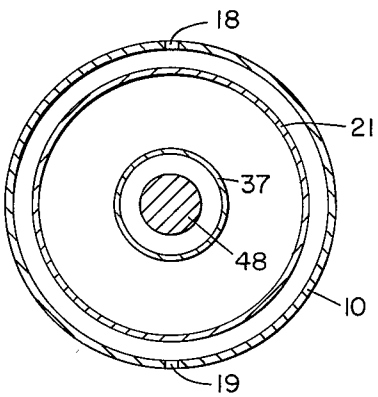

Referring to FIG. 1, longitudinally extending tubular support member 10 of explosive and initiating apparatus 9 is rigidly connected at its rearward end 11 to support plate 12 and at its forward end 13 with, and opening through, shield 14. Shield 14 is disposed in a plane substantially normal to the longitudinal axis of support member 10 and is spaced from rock formation 16 containing borehole 17 in substantially longitudinal alignment with tubular support member 10 for receiving an explosive charge from apparatus 9, as further described.

Tubular support member 10 contains a first slot-type opening 18 through its top sidewall intermediate its ends and extending substantially parallel to the longitudinal axis of support member 10 along a major portion of its length; and a second slot-type opening 19 through its bottom side wall opposing slot opening 18 and generally coextensive with slot 18.

Figure 2:
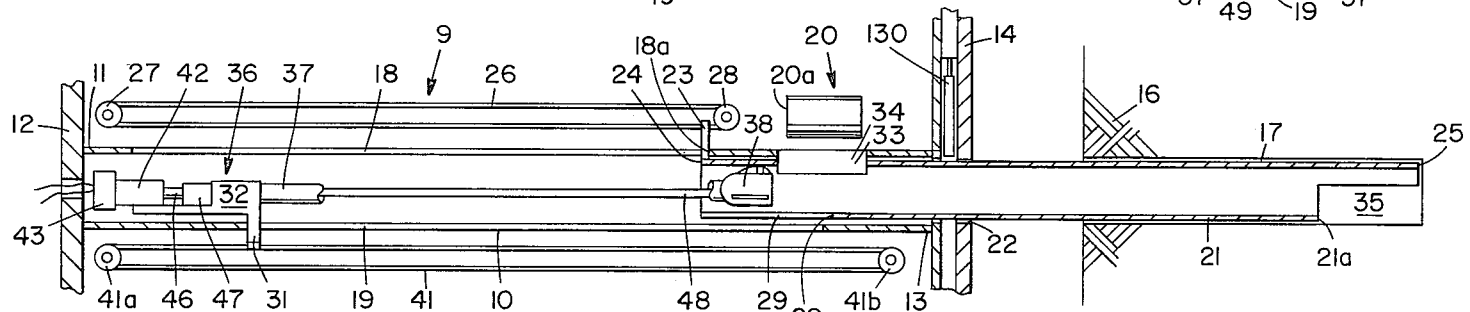

Tubular explosives loading member 21, longitudinally movably supported for advancement and retraction in any suitable manner, is, in the embodiment shown (FIG. 1), within and substantially concentric with, tubular support member 10, and is longitudinally movable in tubular support member 10 through forward end 13 thereof from its retracted position of FIG. 1 through an opening 22 of shield 14 into position in borehole 17, as shown in FIG. 2; and it is then retractable to its position of FIG. 1 as illustrated with reference to FIG. 4 which shows its retraction in progress. In its fully retracted position of FIG. 1, tubular loading member 21 extends in its entirety within tubular support member 10.

Chain connector member 23 extends upwardly from rearward end 24 of tubular loading member 21 for engagement with endless chain 26 outside tubular member 10 which opposes slot 18 and is substantially parallel, and at least coextensive, therewith. Endless chain 26 is rotatably supported on sprockets 27 and 28 respectively rearward and forward of slot 18. Connector member 23 is operatively engaged with chain 26 in any suitable manner, such as shown in FIG. 8, for longitudinally moving tubular loading member 21 in response to rotation of chain 26 on sprockets 27 and 28. Tubular loading member 21 contains an opening 33 in a top rearward side wall section positioned for register, when in advanced position for loading the explosive charge, with opening 34 in a top forward end wall section of tubular support member 10 intermediate sprocket 28 and forward end 13, see also FIG. 2.

Charge displacement assembly 36 includes any suitable charge displacement member forwardly movable in tubular loading member 21 in positive displacement relationship with the explosive charge introduced into tubular loading member 21, together with associated structure including means rearwardly of the charge displacement member for longitudinally moving it. In the embodiment shown, piston head 38, as the charge displacement member, is forwardly movable from a position rearward of the rearward section of tubular loading member 21 into which the explosive charges are successively introduced through the passageway 33 when tubular loading member 21 is advanced as shown in FIG. 2; and, in the embodiment shown, also through passageway 34 of the tubular support member 10 when in register with passageway 33. Although in the fully retracted position of FIG. 1, piston head 38 is not yet suitably axially positioned in tubular loading member 21 for the subsequent forward displacement of the explosive charge, it is moved into the requisite axial position of FIG. 2 in response to advancement of tubular loading member 21 as described further herein.

Piston head 38 contains substantially coaxial passageway 39 therethrough, see FIGS. 1B, 6A, 6B and 6C. Tubular connector member 37 rigidly connects with the rearward end of piston head 38 substantially coaxially with, and opening into, passageway 39, and opens through cylinder mount 32 in a rearward section of tubular support member 10 (FIG. 1) and is secured in mount 32 by set screws 32a and 32b.

Firing pin assembly 45 includes suitable firing pin member 49 forwardly movable from within piston head 38 into percussion impact initiating relationship with the forwardly displaced explosive charge, together with means for advancing the firing pin member into, and retracting it from, the percussion initiating impact. Thus, firing pin assembly 45 includes air cylinder 42 rearward of, and secured to, mount 32, piston member 44 supported in cylinder 42 by O-ring 54 and forwardly movable in cylinder 42 against biasing action of coil spring 44c by force of pressurized air flow regulated by solenoid valve 43 and introduced into cylinder 42 via conduit **44*a* rearwardly of the rearwardmost position of piston 44 in cylinder 42, and conduit 44*b* extending into an end section of cylinder 42 forwardly of piston 44 when the latter is in its forwardmost postion. Coil spring 44*c* is disposed in cylinder 42 forward of, and substantially coaxially with, piston 44, and in contact at its rearward end with piston 44 and at its forward end with the forward end 44*d* of cylinder 42. Piston 44 is retractable from its forwardmost position in cylinder 42 upon reversal of air flow from cylinder 42 via line 44*a* and then in response to force of biasing action of coil spring 44*c*, and conduit 44*b* conveys ambient air flow into and from cylinder 42 during longitudinal travel of piston 44 therein. Cylinder rod 46 extends substantially coaxially from piston member 44 toward mount 32 and connects through connector 47 with pin connector 48 extending within tubular connector 37**.

Any suitable firing pin member can be utilized in the percussion impact initiation of the explosive charge such as firing pin 49 within piston head passageway 39 connecting substantially coaxially within passageway 39 through connector 51 with tubular pin connector 48 and cylinder rod 46. Firing pin member 49, in its fully retracted position, is generally in its entirety within piston head 38. However, firing pin member 49 can extend rearwardly from piston head 38 into operative connection with piston member 44 in any suitable manner. When firing pin member 49 is in retracted position, the forward end 50 thereof does not generally extend beyond a plane substantially coincident with the forward end surface **38*a* of piston head 38. However, in all embodiments, firing pin member 49 is positioned so as to be forwardly movable from within piston head 38** into percussion initiating impact with the forwardly displaced explosive charge.

Slot-type opening 29 in a rearward end wall section of tubular loading member 21 opposes, and is substantially parallel to, slot opening 19 in tubular support member 10. Slot 29 is of sufficient length to permit hook member 31 to extend downwardly therethrough substantially adjacent its forward end **29*a* when tubular loading member 21 is fully retracted as shown in FIG. 1, or is in process of being retracted as shown in FIG. 4. Hook member 31 connecting with cylinder mount 32 extends downwardly through slots 19 and 29 for engagement with endless chain drive 41. Chain drive 41 outside and in close proximity to support member 10 extends parallel to, and facing, slot 19 and is at least coextensive with slot 19. Chain drive 41 is rotatably driven on sprockets 41*a* and 41*b***.

Figure 6:
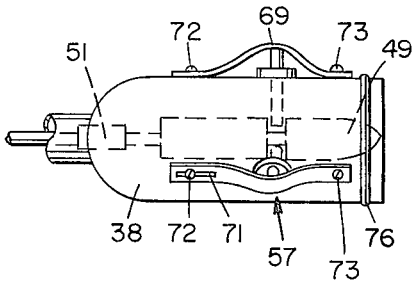
FIG. 6 is an enlarged and more detailed view of forward structure of FIG. 2.
Figure 6A:
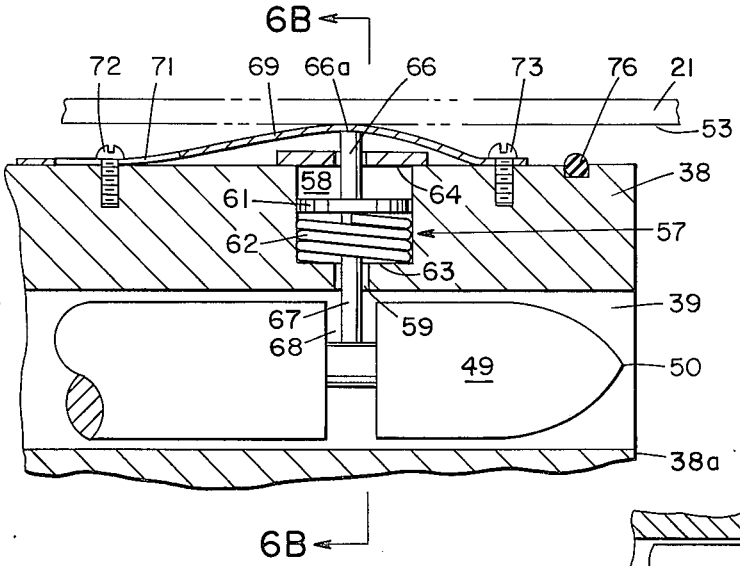
FIG. 6A is an enlarged and more detailed sectional view of the structure of FIG. 6.

In its retracted position for firing, firing pin 49 is locked in piston head 38 by engagement with a plurality of spaced apart spring loaded detent assemblies 57, each extending radially from, and through, the side wall of piston head 38. In each assembly 57, piston chamber 58 opens to the outside of piston head 38, and passageway 59 opens from chamber 58 into passageway 39 in piston head 38; piston 61 is supported in chamber 58 by coil spring 62 which in turn rests on the bottom wall 63 of chamber 58, substantially coaxially with passageway 59, and extends into contact with piston 61 to bias piston 61 upwardly toward top end 64 of chamber 58; a first detent pin member 67 downwardly extends from substantially coaxially secured contact with piston 61 through passageway 59 into piston passageway for engagement with peripheral groove 68 of firing pin member 49 when pin 49 is in retracted position, and a second detent pin member 66 upwardly extends from substantially coaxially secured contact with piston 61 and is longitudinally movable into, and from, the exterior of piston head 38 in response to travel of piston 61. As illustrated in FIG. 6A, firing pin member 49 in retracted position in piston head 38 contains circumerentially extending groove 68 in alignment with each detent pin member 67 so that each pin 67 secured to piston 61 can be moved downwardly in response to downward travel of piston 61 into groove 68 thereby locking pin member 49 from further forward travel. Each assembly 57 also includes a strip-type spring 69 supported on the external wall of piston head 38 and extending across top end 66a of detent pin 66 and having a convex surface facing inner wall 53 of tubular loading member 21. Strip-type spring member 69 contains elongated coaxially extending slot 71 in a rear section and is supported on piston head 38 by rearward and forward screw members 72 and 73 respectively.

When the piston head 38 and firing pin 49 therein are retracted for forward displacement of the explosive charge and subsequent initiation as illustrated with reference to FIG. 2, the inner wall 53 of tubular loading member 21 through spring 69 presses detent pin 66, piston 61 and detent pin 67 against the biasing action of coil spring 62 to move pin 67 into locking position in groove 68. However, when, as described herein, piston head 38 is advanced forwardly from pressing contact of inner wall 53 with each strip 69, each member 69 is movable outwardly into a steeper convex surface to permit spring coil 62 to move against piston 61 and cause detent pin 67 to move upwardly from locking relationship with groove 68, thereby unlocking firing pin member 49 for advancement into initiating position. In the locked position of pin member 49, screw member 72 extends through a forward end of slot 71, and in the unlocked position spring member 69 has moved forwardly along elongated slot 71, thus disposing screw 72 in a rearward section of slot 71. As shown in FIG. 6B, three detent member assemblies 57 equi-spaced apart are advantageously applied concurrently to insure the integrity of the locked position of pin member 49 in piston head 38, and to enhance substantially coaxial support of piston head 38 in tubular loading member 21 during advancement of piston head 38 therein.

The operation of the loading and initiating apparatus 9 is further illustrated with reference to FIGS. 1–4. As shown in FIG. 1, chain connector member 23 is secured to endless chain 26, see also FIG. 8; and tubular loading memer 21 is completely retracted into tubular support member 10. By rotation of endless chain 26 on sprockets 27 and 28 in counterclockwise direction, tubular loading member 21, secured to connector 23 is moved forwardly in tubular support member 10 until opening 33 of member 21 is in register with opening 34 of support member 10. The lengths of tubular loading member 21 and tubular support member 10 are correlated so that the loading member 21 is fully retracted in support member 10, piston head 38 is rearward of opening 34, preferably immediately rearward, and hence positioned rearward of registered openings 34 and 33. Full forward advance of loading member 21 is determined by the position of the forward end wall 18a of slot 18 of support 10 such that connector member 23 forwardly moves into contact with wall 18a to be blocked from further forward travel, and hence to terminate forward travel of tubular member 21.

As tubular loading member 21 is forwardly moved from itsfully retracted position of FIG. 1, the edge 21a thereof forming the rearward side of passageway 35 moves against the spring member 69 and associated pin member 66 in each of the one or more detent assemblies 57 extending across the path of forward travel of edge 21a toward passageway 35 from a periphery of piston head 38. In each instance, the surface of each thus extending detent spring 69 is disposed downwardly and away from edge 21a so that as edge portion 21a moves against the detent spring(s) 69 it forces the spring member 69 to deform sufficiently into the confines of tubular member 21 to dispose all detent pin members 66 within the interior of tubular loading member 21 and with each detent pin 67 pressed into locking engagement with firing pin 49. As shown in FIG. 2, piston head 38 is axially positioned for being moved within tubular member 21 for the forward displacement of the explosive charge.

When apparatus 9 is in place for loading and initiation, tubular loading member 21 is advanced a predetermined distance into the previously drilled borehole 17. Generally, the length of the tubular loading member is correlated with the length of the borehole 17 and with the spacing of the apparatus 9 from the rock face so that the forward end of the advanced loading member 21 is substantially at the bottom, or forward, end of the borehole as shown in FIG. 2. Upon advancement of tubular loading member 21 into the position of FIG. 2, a percussion-initiable explosive charge 20 such as illustrated with reference to FIG. 14, with percussion-sensitive end **20*a* is introduced through registered openings 33 and 34 into emplacement in a rearward section of loading member 21 forward of piston head 38, and with the percussionsensitive end 20*a* facing piston head 38. At that point, piston head 38** is in readiness for advancement to forwardly displace the explosive charge for initiation and subsequent emplacement.

Upon clockwise rotation of endless chain 41 on sprockets 41a and 41b charge displacement assembly 36 connecting through hook 31 with chain 41 is moved forwardly into the position of FIG. 3. In that manner, charge 21 is forwardly displaced by piston head 38 to be moved through advanced tubular loading member 21 to the forward end 25 thereof. The length of the displacement assembly 36 is correlated with that of tubular loading member 21 so as to provide forward displacement of charge 20 a predetermined distance generally to the forward end of the borehole as shown in FIG. 3.

Suitable means, dependent upon the particular charge cartridge and displacement member, is often advantageously utilized for supporting the forwardly displaced charge for the initiation. In the embodiment shown, the explosive charge 20 is supported in alignment with pin member 49 for travel of the pin member into percussion impact initiation with the charge. Explosive charge 20 is cylindrical and its rearward end is recessed to form recess end section 147, see FIG. 14. The forward end of the piston head 38 is dimensioned so as to forwardly move into the recessed end section 147 in friction tight relationship with the inner shell wall thereof through O-ring 76, as shown in FIGS. 6, 6A and 14; and hence the explosive charge friction-fits onto the forward end of the piston head sufficiently to be supported in suspended, substantially coaxial, alignment with the piston head and firing pin members for the percussion impact initiation.

Figure 3A:
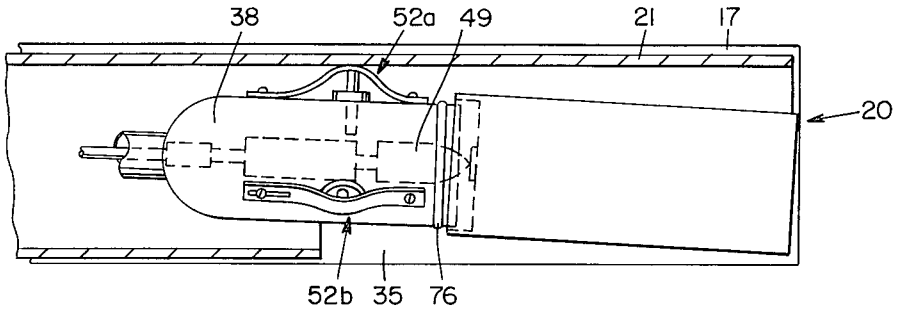

Due to their flexibilties, connectors 37 and 48 are caused by the weight of the advanced piston head and charge secured thereto, to bend downwardly from their rearward points of rigid support when the piston head and explosive charge are in advanced position for the percussion initiation, as illustraed with reference to FIG. 3. Accordingly, the combined charge 20, connector member 37, firing pin connector 48 and piston head 38, when so advanced sufficiently into the forward end of tubular member 21 containing passageway 35, yieldably extend downwardly toward the bottom wall of tubular loading member 21 and passageway 35 to cause each spring member 69 to move from contact with wall 53 sufficiently to dissipate, or eliminate, pressing action of wall 53 against each pin 66 to in turn permit each detent pin 66 to be responsively raised in chamber 58 by force of the biasing action of spring member 62 and concomitantly cause detent pin 67 to move upwardly and out of groove 68 and hence out of locking relationship with pin 49. Firing pin 49 is then free to be forwardly moved into percussion impact with charge 20 being held in alignment for the percussion impact initiation as shown in FIG. 3A. In view of the friction type support of charge 20 on the forward end of piston head 38 the relative positions of charge 20 and piston head 38, when so advanced, remain unchanged to thereby retain the requisite alignment of charge 20 with the pin member 49 for the percussion initiation as shown in FIG. 3. Open passageway 35 is dimensioned for gravitation of the percussion initiated explosive charge therethrough.

Firing pin member 49, unlocked from engagement with each detent pin 67 is adapted to be moved into percussion impact with charge 20 with sufficient force to not only accomplish the percussion initiation but to also force the charge 20 to disengage from friction supported contact with piston 38 for gravitation into opening 35 for detonation, as also illustrated with reference to FIG. 3. In this embodiment, it is necessary that when piston head 38 is forwardly moved for the charge displacement and initiation, at least a rearward section of piston head 38 be retained within the tubular loading member 21 rearwardly of the forward open wall section 35 so as to be readily retractible following the percussion impact.

In other embodiments, in lieu of passage 35 the explosive charge is displaced through the forward end of the tubular loading member a distance short of forward travel of the entire piston head 38 therethrough, but a distance sufficient to move each spring member 69 past the forward end of the tubular loading member 21 to release the press of wall 53 against each detent pin 66 to unlock firing pin member 49 for its requisite forward travel. When referring herein to gravitation of the charge after percussion initiation, it is acknowledged that downward travel of the charge may often in part be responsive to force of the percussion initiating impact.

When piston head 38 is in position facing percussion-sensitive end **20*a* of explosive charge 20 as shown in FIG. 3, pressurized air is charged to air cylinder 42 through conduit 44*a* to forwardly move piston 44 against the biasing action of spring 44*c* with the discharge of ambient air from the forward and opposing end of cylinder 42 through conduit 44*b*. Accordingly, air cylinder piston rod 46 and hence firing pin connector rod 48 connecting therewith is moved forwardly a predetermined distance equal to that of the requisite forward travel of firing pin 49 for the percussion initiating impact with charge 20. Thus, by that distance firing pin 49 having its forward end 50 substantially flush, or in close proximity to, the forward end surface 38*a* of piston head 38, advances from piston head 38 into aligned percussion impact with the percussion-sensitive end 20*a* of the explosive charge to percussion initiate and disengage charge 20 from its friction supported contact with piston head 38, for gravitation into emplacement through passageway 35**.

The main explosive charge of the delay type percussion initiatable charge assembly 20 is generally of the NCN-type. A suitable percussion initiatable charge is disclosed in U.S. Pat. No. 3,509,820, which disclosure is incorporated herein by reference, albeit the now-preferred form of that percussion initiatable charge is further illustrated herein with reference to FIG. 14.

It is mandatory that the piston head 38, firing pin 49 and tubular loading member 21 be moved into retraction a sufficient distance that they are free from damage by force of detonation of the main explosive charge; and that they are movable to a position rearward of shield 14, or preferably into full retraction in tubular support member 10, during the burning time of the delay charge, which is generally from about 0.5 to 5.0 seconds.

As shown in FIG. 4, tubular loading member 21 in response to clockwise rotation of endless chain 26, travels toward retraction into tubular support member 10. Upon retraction of tubular loading member 21, it initially engages hook assembly 31 through rearward slot 29 in alignment therewith and it carries the integral piston assembly 36 thus engaged therwith including firing pin 49 carried therein toward retraction position as shown in FIG. 4, and into full retraction of FIG. 1. After the tubular loading member 21 and piston head 38 have passed in reverse travel through shield 14 toward the rearward end of tubular support 10, generally into full retraction in tubular support member 10, detonation of the charge takes place. The tubular loading member 21 in its fully retracted position is then ready for realignment with a succeeding borehole for initiation emplacement and detonation of a succeeding explosive charge 20.

Firing pin 49, after firing, can be retracted to its firing position in piston head 38 at any time by reverse travel of pressurized air through conduit **44*a* to permit spring 44*c* by force of its biasing action against piston 44 to move piston 44 and in turn retract pin 49 into locked position in piston head 38** as above described.

Although piston 44 is preferably pneumatically operated in combination with spring biasing means **44*c*, as above described, it can be operated by flow of pressurized fluid, generally air, via conduit 44*a* into cylinder 42 with discharge of displaced fluid from the forward end of cylinder 42 through conduit 44*b* to forwardly move piston 44 for responsively moving firing pin 49 into the requisite percussion impact, with reversal of fluid flow through conduits 44*b* and 44*a* for rearwardly moving piston 44 for retraction of firing pin 49**.

Piston head 38 is carried rearwardly in response to retraction of tubular loading member 21 with its detent pin members 66 out of pressing contact with the inner wall of tubular loading member 21, i.e., in the position shown in FIGS. 1, 3A and 4, and it remains in that position until tubular loading member 21 is advanced as illustrated and discussed herein with reference to FIG. 2, at which time it is axially disposed for the forward displacement of the explosive charge.

In initiating operation of assembly 9, all members are in full retraction as shown in FIG. 1. Air is introduced under pressure in lines 81 and 91 to place solenoid valves 79 and 87 in operative readiness. The electric circuit control through lines 84 and 86 is actuated and air flow through four-way valve 79 is directed to operate reversible air motor 82 to cause the sprocket 27 to move chain 26 to thus move tubular loading member 21 forwardly. There is no rotation of sprockets 27 and 28 until motor 82 is engaged by clutch 83 in turn operatively connecting with sprocket 27. Control circuit through lines 88 and 89 is then opened to cause air operation clutch 83 to engage gear reducer 78 with sprocket 27 to cause travel of tubular loading member 21 into forward position of FIG. 2.

When loading tube 21 advances to a forwardmost position determined by slot 18 and connector 23, as above described, the air motor is stalled, thus preventing damage to the chain drive and connector member 23 linkage associated therewith. Air supply to the air motor 82 and clutch 83 is then terminated.

At this point, the loading ports 33 and 34 are in register with the other and hence in position to accept a charge assembly 20 for emplacement in loading tube 21, the piston head 38 being in position immediately rearward of the thus registered ports. Charge assembly 20 is then introduced into the loading tube 21 through the ports 33 and 34. The now-preferred charge is advantageously contained in an elongated metal can having the percussion-sensitive recessed end portion as discussed above, and the extended sidewall of the charge is fitted around the end of the piston head 38 friction tight with an O-ring 76 on the outer wall of piston head 38 as described hereinabove.

An air motor (not shown) directly operatively connecting with one of the sprockets 41*a* and 41*b* to move chain member 41 clockwise is then actuated, without need for electrical control or a clutch, to move piston assembly 36, when engaged with hook 31, to its forwardmost position of FIG. 3. As the piston assembly approaches maximum forward extension, hook 31 engages track 93 (see FIG. 9) which extends upwardly from the initial point of contact with hook 31 to secured contact at its upper end with the bottom of tubular support member 10 by suitable screw bolts 94 and 96, as illustrated with reference to FIG. 9. As shown in FIG. 9, hook means 31 includes downwardly extending section 31a toward endless chain 41 from cylinder mount 32, which joins forwardly extending hook section 31*b* pivotally secured thereto by pin 31*c,* and hook section 31*d* extending downwardly from member 31*b* through pin 31*e* for engagement of chain 41 with notch 31*f* at the downwardmost end of section 31*d,* and facing rearward end 11 of tubular support member 10 for engagement with a link member of chain 41 further shown in FIG. 8A.

As section 31*d* is engaged through notch 31*f* with clockwise rotation of endless chain 41, piston assembly 36 is moved forward; and as it contacts track 93, laterally extending pin member 31*e,* see FIG. 9A, is caused by drive of chain 41 to engage and ride forwardly and upwardly on track 93. As pin 31*e* continues forwardly on rack 93, section 31*b–31d* raises on pivot 31*c* until hook section 31*d* through groove 31*f* is forced out of engagement with chain 41. The location of track 93 on support 10 is correlated with that of hook assembly 31 so that when hook assembly 31 has traveled the predetermined distance for carrying the piston assembly 36 into its position of FIG. 3, it has engaged track 93 in the delatching operation.

Thereafter, air pressure to the system operating chain 41 is terminated. The air supply is then applied via motor 82, except in reverse operating direction, to cause clockwise rotation of sprocket 27 for rearwardly moving endless chain 26 for retraction of tubular loading member 21. However, the clutch 83 is not yet activated and tubular loading member 21 remains stationary. Air is then supplied to the air cylinder 42 for forward movement of firing pin 49 and the charge is thus initiated.

As illustrated with reference to FIG. 10A, a separate circuit is provided including lines 98 and 99 connecting across battery 100 for applying through electropneumatic means, the necessary electrical circuit to the tubular loading member 21 via clutch 83 when motor 82 is in reverse direction, and concurrently to the solenoid valve 43 to simultaneously activate the clutch and firing pin causing the firing pin 49 to move into percussion impact relationship with the percussion-sensitive end 20*a* of explosive charge 20 and concurrently initiate reverse travel of tubular loading member 21. The motor 82 having been previously started in reverse direction but not engaged with sprocket 27 is in full speed when the clutch and firing pin are actuated to thereby accomplish complete and prompt retraction of all components during the delay period, which begins with the percussion initiation upon activation of the firing pin together with concurrently initiated rearward travel of tubular loading member 21. In response to the force of percussion initiating impact of firing pin 49 with charge 20, the explosive charge 20 is disengaged from piston heat 38 and gravitated into emplacement through passageway 35. Emplaced explosive charge 20, free from contact with piston head 38 and tubular loading member 21 cannot be drawn into the retraction travel of thoe members 38 and 21. The duration of the delay, and hence the time period during which the retraction of all components is complete is generally within the above described duration of 0.5 to 5 seconds.

in another embodiment as illustrated with reference to FIG. 6C, firing pin 49*a* in passageway 39 of piston head 38 is moved into and from percussion initiating impact with the explosive charge 20 in the same manner as above described with reference to firing pin 49, except that it is forwardly moved against the biasing action of coil spring 40 in piston head 38 and it is retracted from percussion impact in response to the combined biasing action of coil springs 44C and 40. Further, coil pring 40 by its biasing force opposes forward travel of firing pin 49*c* into percussion impact with the explosive charge 20 in the event of any misfunction of the apparatus that may tend to cause the firing pin to forwardly move uncontrolled.

Figure 6C:
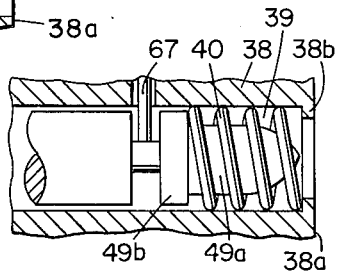
FIG. 6C is a view of a modified form of structure of FIG. 6A.
Figure 6B:
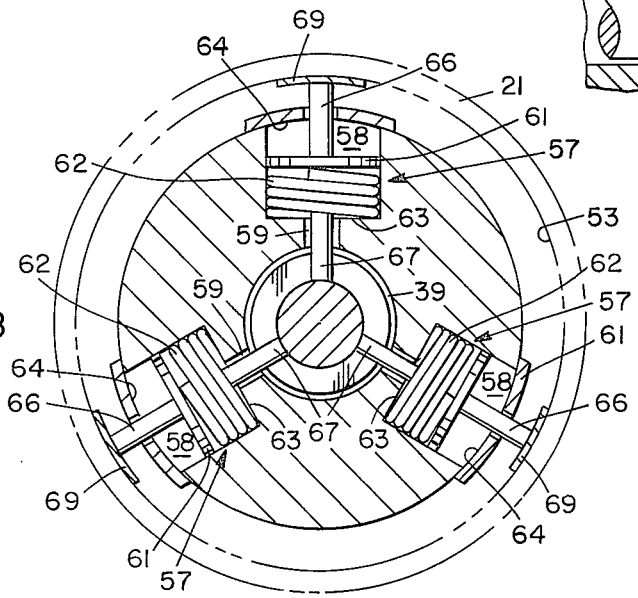
FIG. 6B is an enlarged and more detailed view taken along the line 6B—6B of FIG. 6A.
Figure 7:
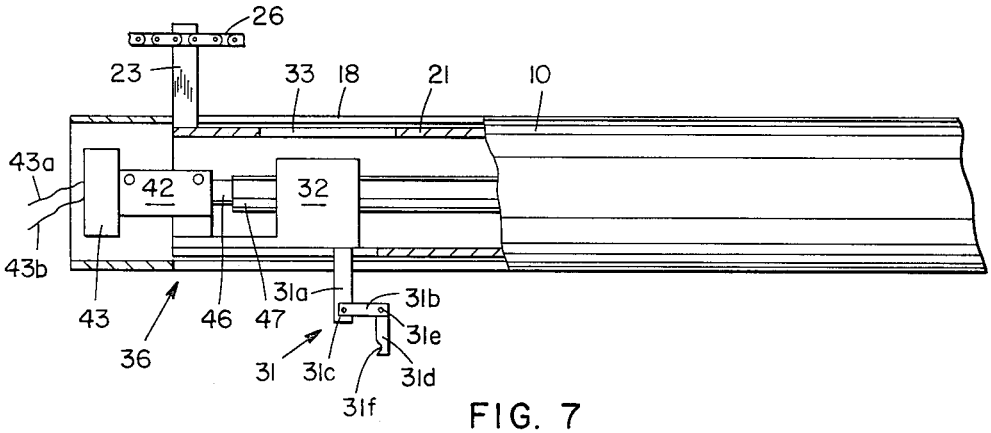
FIG. 7 is an enlarged view of a rearward portion of the apparatus of FIG. 1 and it differs from FIG. 5 particularly with reference to slot structure in a rearward end section of the tubular loading member operatively associated with hook means for responsively retracting the charge displacement member with the tubular loading member after initiation of the explosive charge.

Thus, as shown in FIG. 6C, coil spring 40 is disposed in a forward section off piston head 38 coaxially therewith. Firing pin 49*a* is dimensioned so as to forwardly and coaxially extend into coil spring 40, often to a point about flush with the end surface 38*a* of piston head 38 when in locked position therein. Pin 49*a* includes stop member 49*b* extending radially from and peripherally about a rear section intermediate groove 68 and coil spring 40 sufficiently to encompass the rearward end of coil spring 40 a support therefor. Stop member 38*b* at the forward end 38*a* of piston head 38 extends from the peripheral inner wall 53 into passageway 39 sufficiently to encompass and support spring 40 within passageway 39 at its forward end but insufficiently to block forward travel of pin 49*a* through coil spring 40 into percussion impact with the explosive charge 20. Coil spring 40 supported under compression intermediate and against stops 49*b* and 38 *b* thus biases pin member 49*a* rearwardly; and when pin member 49*a* is forwardly moved into percussion impact, piston 44 in cylinder 42 necessarily moves in response to sufficient force of pressurized air to overcome the biasing force of pin 49*a*.

The explosive loading and initiating apparatus of the invention is supported and operated in the blasting of earth formations in combination with suitable drill means. In now preferred practice, it is applied as a component of a continuous drilling and blasting apparatus for excavating hard rock formations furthher illustrated with reference to FIG. 11. The assembly of FIG. 11 includes mechanical means for cutting a relief opening in the center of the tunnel face and means for then drilling adjacent boreholes and firing an explosive charge in each borehole. The machine is retained at the working face of the tunnel at all times to effect drilling and blasting as well as removal of broken blasting product material, often referred to as muck, essentially continuously with only momentary cessation of drilling and muck removal during the actual loading and detonation of the explosive charges.

Referring to FIG. 11, drill and blasting apparatus 101 in tunnel 102 in rock formation 16 is spaced from rock face 104 in position for the drilling/blasting operation. Outer and inner tubular support members 106 and 107 are substantially concentric and extend forwardly toward rock face 104. Rotatable tubular drive shaft 108 extends through, and substantially concentric with support tube 107. Support plate member 12 forwardly of tubular support 107 is disposed substantially normal to the longitudinal axis of drive shaft 108, and shield 14 is spaced forwardly of support plate member 12 and is disposed in spaced-apart relationship with the rock face 104. Drive shaft 108 extends forwardly through support plate member 12 and opens through shield 14, and rigidly connects with support plate 12 and shield 14. Rotary drill stem 112 extends through and substantially concentric with, tubular shaft member 108 and operatively connects, for rotation, with motor 113 rearwardly of support tubes 106 and 107, and at its forward end with drill bit 114 in position for drilling a main relief borehole in the rock face 104. One or more drill units 116 and one or more explosive loading assemblies 9 of the invention are supported in position forwardly extending from support plate member 12 to, nd operatively through, shield 14 of machine 101 for drilling and loading boreholes in rock formation 16.

Separte sets 117 and 118 of support legs, each set respectively having three equi-angularly spaced legs 117*a,* 117*b* (not shown), and 117*c* and 118*a,* 118*b* (not shown) and 118*c,* are respectively disposed around tubular member 107 rearwardly and forwardly of tubular support 106 and substantially radially from tube support 107 toward the inner wall 102*a* of tunnel 102. Similarly, separte sets 119 and 121 of support legs 119*a,* 119*b* (not shown) and 119*c* and 121*a,* 121*b* (not shown) and 121*c* are each equiangularly spaced around tubular support member 106 respectively at the rearward and forward ends thereof. Each of the legs of sets 117, 118, 119 and 121 are of the hydraulic cylinder type and are extendible into and from engagement with tunnel wall 102*a* to lock the machine in operation or to move it forwardly for further operation. Each of the legs of the four sets includes a piston rod e which telescopes into and from the outer end of each of he cylinders and has a foot f at its outermost end for engaging the tunnel wall when the rod is extended from the cylinder.

During operation, rods e of leg sets 117 and 118 are extending into locking contact with the tunnel inner wall 102*a* and the legs of sets 119 and 121 are out of contact with the tunnel inner wall due to retraction of the piston rods e into the cylinder in each instance. In order to forwardly advance the machine for further operation, the rods e of the sets 119 and 121 are extended into contact with wall 102*a.* Rods *e* of sets 117 and 118 are then retracted by withdrawal into the respective cylinder from contact with wall 102 *a* and then support tube 107 is forwardly moved through support tube 106 into the succeeding operating position. Rods *e* of sets 117 and 118 are then extended into locking contact with wall 102*a* followed by withdrawal of rods e of leg sets 119 and 121. Support tube 106 is then forwardly moved over support tube 107. The machine 101 is thereby secured for the next operating cycle.

Motor 112 is secured to leg 117a, and gear means 123 operatively connects with motor 122 and an end section or rotatable drive shaft 108 rearward of tubular member 107 to rotatably drive shaft member 108 on its longitudinal axis through an angle generally in the order of about 180°.

Motor 113 is supported on rearwardly extending rack member 124 which is supported at its opposite sides by connection with legs 117*b* (not shown) and 117*c,* and by triangular apron members 126 rearwardly extending along each side of rack 124 and downwardly along each leg 117*b* and 117*c.*

Track 127 extends rearwardly on rack 124 and carries motor 113 for forward and rearward travel; and endless chain member 125, disposed below track 127 and substantially parallel therewith, is in direct operative engaging relationship with motor 113 for moving same forwardly to move drill stem 112 and bit 114 into and from drilling position. Chain member 125 is rotatably moved by motor 120 mounted between legs 117*b* (not shown) and 117*c.*

Mucking and conveyor system 128 is carried in any suitable manner on machine 101 for conveying breakage product for further processing and comprises a pair of continuous belts 128*a* and 128*b* in series on suitable rotatable support means 128*c* for collecting the breakage product for delivery to the rear of the machine.

As illustrated, at least one explosive loading assembly 9 and at least one drill unit 116 is disposed in the forward end of machine 101, and is supported at its rearward end at plate 12 and at its forward end at shield 14; and each is in alignment with an opening 22 through shield 14 for moving into and from operative relationship with the earth formation to be drilled and blasted. Except for those drill units and loader assemblies radially outwardmost, all are substantially parallel to the longitudinal axis of tubular shaft member 108, the outermost drill units and/or explosive loaders extending upwardly from support plate 12 toward the tunnel wall 102*a.* The drill units 116 are of any suitable conventional design. Each drill unit is extended through the requisite opening in shield 14 during the drilling operation; and after the hole is drilled the bit is withdrawn. Plate 12 and shield 14 are rotated on the longitudinal axis of shaft 108 by rotation of shaft 108 driven by motor 122 for placing each explosive loading device in the required alignment for loading previously drilled borehole. After the explosive tube 21 is in alignment with the borehole and then advanced, the charge assembly 20 is initiated, and then advanced loading tube 21 and the components therein are retracted for the detonation, as decribed hereinabove.

The individual explosive charges can be fed into the loading tube 21 in any suitable manner as indicated by the loading line 129. One such means comprises pneumatic tubes extending through plate 12 from the control cab 111 rearwardly of leg set 121, each tubular member extending intermediate the members of each leg set 121 118 and having sufficient flexibility to compensate for the rotation of the plate 12 to a maximum of about 180°. Shield 14 contains openings 22 as above described and contains slidable plate closure means 130 for each opening 22 to protect the drill or loader when not in operation.

A now-preferred embodiment of drilling/loading structures of the machine 101 is further illustrated with reference to FIG. 12, which shows a system of openings 22, tracks B and D for the mounts for rotary drills 116 and tracks A and C for the mounts for explosive loader assemblies 9. In the embodiment of FIG. 12, and as shown with reference to the openings 22 in shield 14, tracks for ends of the mountings for each of the drill units 116 and explosive assemblies 9, except for those outermost, are disposed radially from the axis of the shaft 108. Drill units 116 and explosive assemblies 9 are radially movable along these four equispaced-apart tracks A, B, C and D. The forward end of each explosive loader assembly and drilling unit mounted in shield 14 is movable along the track the same distance as is the rearward end supported in plate 12 (not shown), thus assuring constant parallel relationship of the explosive loading and drill unit with central shaft 108 at all times. Any suitable means can be provided for equi-distantly radially moving the rearward and forward ends of each loader member 9 and drill unit 116 such as by an air or hydraulic cylinder assembly, a two-motor drive or the like. Thus, as illustrated with reference to the openings 22 of FIG. 13, a plurality of loading units 9 and drill units 116 are disposed equi-spaced along each of the four tracks and each successive loading assembly and/or drill unit is supported on a circle having its radius extending from the longitudinal axis of shaft 108. Hence, each successive set of loading tube assemblies and/or drilling units forms a ring of those components, the tubular loading member, and drill units being radially disposed to form four concentric rings 136 in the embodiment illustrated.

A track assembly 131 extends on each shield 14 and plate 12 along each radial path and each tubular explosive loading member 21, or drill unit 116, connects at its forward end through a base plate in engaging relationship with the adjacently positioned track member so as to be slidable along each track member to maintain the desired radially spaced relationship. Inasmuch as the same arrangement of track and connector structure is disposed on the forward face of plate 12, each explosive loading tube and drilling unit can be moved on plate 12 an equal distance along the given radius to maintain the requisite parallel relationship with the drive shaft 108.

However, each outermost tubular explosive loading and drill unit extends angularly upward from plate 12 and is supported at its rearward end by pivot means at the forward face of plate 12, and connects at its forward end with plate 132, which extends from a track 131, and then through opening 133 therein so that each forward end is moved radially along a separate track (not shown) mounted on the extended plate 132. The forward end of each loading tube and drill unit is moved radially on that track member on plate 132 through a telescoped-type base plate connector connecting the drill unit or loading assembly with that track member into position for drilling or loading outwardly from parallelism into the direction of the tunnel advance. Without the angling-out feature, the general cross-section of the tunnel opening would of necessity continually decrease inasmuch as a truly parallel borehole cannot be drilled at the very extreme edge of the tunnel face.

In order that the entire rock face be accessible to the drill units and to the loading assemblies, there must be a rotation of the shaft 108 as above described to allow the tubular loading assemblies to move through openings 22 into alignment with boreholes previously drilled by the drills which are mounted 90° apart on shield 14. There is generally a larger number of drills than loading assemblies due to the longer time required for drilling the boreholes than for loading, hence the drilling of multiple holes is advantageous from the standpoint of minimum time cycle.

As further shown in FIG. 12, blast shutters 134 are provided along the periphery of shield 14 and are curved along their edges adjacent the tunnel wall **102*a* so as to maintain the peripheral space between shield 14 and the tunnel wall 102*a* at a minimum to in turn protect from rearwardly flying rock breakage. Thus, each shutter 134 is hinged on the peripheral surface of shield 14, there being three such sets of equi-spaced surfaces 137** in the embodiment shown.

The fourth and remaining surface **137*a* facing the bottom of the tunnel wall and free from shutter means 134 provides space for operation of the mucking and conveyor system 128** to move breakage rearwardly as above described.

Each shutter 134 is moved on its hinged side by conventional hydraulic cylinder means secured at its cylinder end to shield 14 and having its rod component secured to the rearward surface of the shutter member. When the shutters 134 are in peripherally closed position, as shown in FIG. 12, each set is spaced from an adjacent set to provide an open space 138 to permit positioning of a plate 132 and hence pivotally angled loading and/or drilling assemblies to extend into the face of the formation through the openings 133.

When there is no angular drilling or loading, the openings 133 are closed such as by a hydraulically drawn sliding closure plate (not shown); and that slidable plate is similarly hydraulically driven to be moved away from the closing position when the drill unit is in operation or loading is to be carried out. Conventional sensor means are advantageously utilized to detect ingress and egress of the drill unit and/or explosive loader and cause the slidable plate member to move into, or from, closing relationship with that passageway.

As illustrated with reference to FIG. 13, a separate screw member 141 threadably engaged with a nut 139 so as to be rotatably movable therethrough is disposed adjacent each end of each loader assembly 9 and drill 116 and is supported at its opposite end by a bearing 142 supported on the inner wall of shield 14. Each screw member 141 is rotatably driven by hydraulic means 143. To move the tube or drill unit the desired distance, each screw member 141 is rotated to maintain the parallel relationship above described.

Referring to FIG. 14, which further illustrates a now-preferred delay type percussion initiatable explosive charge assembly 20, elongated shell 144 contains intermediate wall closure 146 to provide end recessed section 147. The closed portion of shell 20 contains an NCN (nitrocarbonitrate) type main explosive charge 148; and a delay type percussion-initiatable primer assembly 149 supported in well member 151, extends through wall enclosure 146 into detonating relationship with NCN charge 148. Primer assembly 149 comprises elongated closed shell 152 including top end closure 20*a* containing a percussion-sensitive ignition charge, base explosive charge 153 spaced therefrom, primer assembly 154 superposed on base charge 153, delay fuse assembly 156 superposed on primer assembly 154 and spaced from end closure 20*a.* Top closure 20*a* is preferably an empty primed rifle cartridge casing 157 with the percussion-sensitive charge 20*c* spaced from delay assembly 156. In the embodiment shown, primer assembly 154 comprises a diazodinitrophenol charge 154*a* within open ended capsule 154*b* and a higher density diazodinitrophenol charge 154*c* pressed on to capsule 154*b;* and delay assembly 156 comprises a conventional core 156*a* of suitable delay fuse charge such as barium peroxide/-tellurium, barium peroxide/selenium, or the like, pressed in a lead tube 156. In operation, base charge 153 is detonatable in response to detonation of primer charge 154*a,* primer charge 154*a* is detontable in response to burning of the higher density primer charge 154*c* in turn ignitable in response to burning of delay charge 156*a,* and delay charge 156*a* is ignitable by heat and flame developed by percussion ignition of the ignition charge 20*c* in the empty primer rifle cartridge casing closure member. Exemplary of conventional base charge 153 are PETN, Tetryl, and the like; and exemplary of conventional percussion-sensitive ignition charges 20*c* are lead styphnate, mercury fulminate, antimony sulfide and lead axide, and mixtures of such materials.

In lieu of the rifle cartridge casing closure 157, the top end closure of the primer assembly can be any suitable end wall/percussion-sensitive ignition member, as further described in U.S. Pat. No. 3,509,820. In all events, the percussion-sensitive ignition charge is supported on the inner wall of the end top closure member 20*a* of the primer assembly 149 so as to be compressed in response to percussion applied to the wall member from outside the primer shell, and ignitable in response to compression resulting from force of that percussion impact.

As further illustrated, the recessed end portion 147 of charge assembly 20 of FIG. 14 is proportioned so as to fit over the forward end of the piston head 38 and around O-ring 76 to provide suitable friction-type support of the charge 20 assembly by piston head 38 for the percussion initiation.

As will be evident to those skilled in the art, various modifications can be made or followed, in light of the foregoing disclosure and discussion, without departing from the spirit or scope of the disclosure or from the scope of the claims.

What I claim and desire to protect by Letters Patent is:

1. A method for loading and initiating a delay type percussion initiatable explosive charge in an earth formation for subsequent detonation to form earth breakage product, which comprises:

displacing said explosive charge by positive displacement means into a borehole in said earth formation for initiation of same;

supporting the thus displaced explosive charge so as to be initiatable by force of percussion impact of an advancing pin, and advancing said pin into said percussion initiating impact; and concurrently withdrawing said pin and said positive displacement means from said borehole during the period of said delay.

2. In a method of claim 1, supporting said displaced explosive charge in substantially coaxially aligned contact with said displacement means, and advancing said pin through a central passageway in said displacement means into said percussion initiating impact.

3. In a method of claim 1, advancing a piston member as said positive displacement means in supported contact with said explosive charge during displacement of same and retaining said displaced explosive charge in said supported contact for said percussion impact initiation, and disengaging the thus initiated explosive charge from said contact with said piston member by said force of percussion impact of said pin member, whereby said explosive charge is concurrently initiated and freed from said piston member and said pin for said detonation.

4. Apparatus for loading and initiating delay type percussion initiatable explosive charges in bore holes, which comprises:

a tubular loading member having a passageway in a side wall thereof for receiving an explosive charge;

means for moving said tubular loading member into and out of a bore hole;

means for advancing said charge within said tubular loading member into emplacement within said bore hole;

means mounted to said advancing means for impacting said emplaced charge to initiate said charge; and means responsive to actuation of said impacting means for actuating said moving means to retract said tubular loading member and said advancing means from said bore hole during the delay period of said initiated charge.

5. The apparatus of claim 4 wherein said advancing means includes means for supporting said charge and disengaging said charge in response to said impacting means and initiating said emplaced charge.

6. The apparatus of claim 4 including a tubular support member having a passageway in a side wall thereof, said tubular loading member being movably supported within and coaxial with said tubular support member, the passageway of said tubular loading member being alignable with the passageway of said tubular support member to allow said tubular loading member to receive an explosive charge.

7. The apparatus of claim 6 wherein said tubular support member includes first and second longitudinally extending slots through a side wall thereof, said moving means includes a first drive means mounted outside said tubular support member operatively connected through said first slot to said tubular loading member for longitudinally moving and retracting said tubular loading member.

8. The apparatus of claim 7 wherein said advancing means includes a piston head as a charge displacement member mounted for movement within said tubular loading member and a second drive means mounted outside said tubular support member operatively connected through said second slot to said piston head for longitudinally moving said charge within said tubular loading member.

9. The apparatus of claim 7 wherein said means responsive to actuation of said impacting means includes electropneumatic means operatively connected to said first drive means for activating said first drive means in a reverse direction for retracting said tubular loading member and said advancing means.

10. The apparatus of claim 8 wherein said impacting means includes a firing pin disposed within said piston head, said firing pin being longitudinally movable relative to said piston head for impacting with said charge.

11. The apparatus of claim 10 wherein said impacting means includes a mounting member rearward of said piston head, a tubular member connecting said piston head and said mounting member, said mounting member operatively connected through said second slot of said tubular support member to said second drive means, a pin connector member extending within said tubular connecting member and connecting at its forward end with said firing pin, and pneumatic means connecting with said pin connecting member at its rearward end through said mounting member for longitudinally moving said pin connector member and said firing pin so that said firing pin impacts with said charge.

12. The apparatus of claim 11 wherein said pneumatic means includes a piston assembly rearward of, and secured to said mounting member, said piston assembly including a cylinder, a piston movable within said cylinder, a piston rod having one end connected to said piston and the other end projecting from said cylinder and connected to said pin connector rod, and means for spring biasing said piston against forward travel; and wherein said pneumatic means includes means for introducing fluid under pressure into said cylinder to move said piston.

13. The apparatus of claim 11 wherein said impacting means also includes a plurality of spaced apart detent assemblies each radially extending from, and through the side wall of said piston head, and said firing pin has a substantially radially disposed groove formed about its periphery; first and second detent pin members in each said detent assembly, said first detent pin member longitudinally movable into, and from, said passageway in said piston head for extension into, and retraction from, said groove to respectively lock said firing pin therein, and unlock same for forward travel into said percussion initiating impact with said charge, and said second detent pin member longitudinally spaced from said first detent pin member and longitudinally movable into, and from, the exterior of said piston head; spring biasing means in each said detent assembly operatively connecting with said first and second detent pin members therein to bias said first detent pin member away from said locking position in said groove and to bias said second pin member toward a position outside said piston head, so that when said piston head is sufficiently within said tubular loading member to retain said detent assemblies therein, the side wall of said tubular loading member will press against each said second detent pin member to responsively move said first pin member into said groove in opposition to the biasing force of said spring means; and said piston head sufficiently forwardly movable in a forward section of said tubular loading member to move said second detent pin members from said pressing relationship with the side wall of said tubular loading member to responsively move said first detent pin members from said groove to unlock said firing pin for travel into said percussion initiation impact with said charge.

14. The apparatus of claim 13 wherein said tubular loading member includes in a forward end side wall section, a passageway therethrough dimensioned for egress of each said forward displaced charges; and said piston head when forwardly displaced into its forwardmost position being responsively downwardly movable toward and partially into said forward end passageway to release each said second detent pin member from said pressing relationship with said tubular loading member, so that each said spring member by force of said biasing action moves each said first pin member upwardly from said groove to unlock said firing pin for travel into said percussion initiating impact with said charge.

15. Apparatus for loading and initiating a percussion initiatable delay type explosive charge in a bore hole which comprises:

a longitudinally extending tubular support member positionable in alignment with and adjacent to said bore hole;

a tubular loading member having a passageway in a side wall thereof for receiving an explosive charge, said tubular loading member being longitudinally movable within and through a forward end of said tubular support member so as to be advanced into said bore hole from within said support member;

means for moving said tubular loading member through said forward end of said tubular support member into and out of a bore hole;

means for advancing said charge within said tubular loading member into emplacement within said bore hole;

means mounted to said advancing means for impacting said emplaced charge to initiate said charge; and means responsive to actuation of said impacting means for actuating said moving means to retract said tubular loading member and said advancing means from said bore hole during the delay period of said initiated charge.

16. Apparatus for drilling and blasting to form earth breakage product comprising:

a support member;

means for rotation of said support member;

a centrally disposed drill carried by said support member for drilling a relief hole in an earth formation;

a plurality of space-apart drilling units, each carried by said support member for forming a bore hole in said earth formation, each of said drilling units spaced from said centrally disposed drill;

means mounted to said support member for loading and initiating delay type percussion initiatable explosive charges in said bore hole including:

a tubular loading member having a passageway in a side wall thereof for receiving an explosive charge, means for moving said tubular loading member into and out of a bore hole, means for advancing said charge within said tubular loading member into emplacement within said bore hole, means mounted to said advancing means for impacting said emplaced charge to initiate said charge, and means responsive to actuation of said impacting means for actuating said moving means to retract said tubular loading member and said advancing means from said bore hole during the delay period of said initiated charge; and means for advancing said support member toward said earth formation for said drilling and loading and subsequent initiation of each of said explosive charges for detonation to form said breakage product.

17. A method for loading and initiating a delay type percussion initiatable explosive charge in an earth formation, which comprises:

moving said delay type explosive charge into a bore hole in said earth formation;

advancing a percussion member into contact with said charge to initiate said charge; and withdrawing said percussion member from said bore hole during the delay period of said charge.

18. The method of claim 17 including supporting said charge during movement thereof into said bore hole.

* * * * *

UNITED STATES PATENT AND TRADEMARK OFFICE

CERTIFICATE OF CORRECTION

PATENT NO. : 4,040,355

DATED : August 9, 1977

INVENTOR(S) : Robert B. Hopler, Jr.

It is certified that error appears in the above-identified patent and that said Letters Patent are hereby corrected as shown below:

Col. 2, line 41 " portion " should read -- position --.

Col. 3, line 20 " ciomprises " should read -- comprises --.

Col. 3, line 49 " said " should read -- same --.

Col. 7, line 49 " memer " should read -- member --.

Col. 9, line 3 " illustraed " should read -- illustrated --.

Col. 11, line 59 " rack " should read -- track --.

Col. 12, line 32 " thoe " should read -- those --.

Col. 12, line 37 " in " should read -- In --.

Col. 12, line 46 " pring " should read -- spring --.

Col. 13, line 10 " furthher " should read -- further --.

Col. 13, line 46 " nd " should read -- and --.

Col. 13, line 49 " Separte " should read -- Separate --.

Col. 13, line 66 " he " should read -- the --.

Col. 14, line 18 " Motor 112 " should read -- Motor 122 --.

UNITED STATES PATENT AND TRADEMARK OFFICE

CERTIFICATE OF CORRECTION

PATENT NO. : 4,040,355

DATED : August 9, 1977

INVENTOR(S) : Robert B. Hopler, Jr.

It is certified that error appears in the above-identified patent and that said Letters Patent are hereby corrected as shown below:

Col. 14, line 20 " of " should read -- or --.

Col. 14, line 66 insert " loading " between -- explosive tube --.

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*